United States Patent [19]

Krill et al.

[11] Patent Number: 4,543,940

[45] Date of Patent: Oct. 1, 1985

[54] SEGMENTED RADIANT BURNER ASSEMBLY AND COMBUSTION PROCESS

[75] Inventors: Wayne V. Krill, Sunnyvale; Thomas Wong, Menlo Park; James Gotterba, Santa Clara, all of Calif.

[73] Assignee: Gas Research Institute, Chicago, Ill.

[21] Appl. No.: 523,799

[22] Filed: Aug. 16, 1983

[51] Int. Cl.[4] ..... F24C 3/04

[52] U.S. Cl. ..... 126/92 AC; 431/328; 126/92 R; 126/92 C

[58] Field of Search ..... 126/92 AC, 92 C, 92 B, 126/92 R; 431/12, 170, 278, 285, 328, 326, 329, 174

[56] References Cited

U.S. PATENT DOCUMENTS

| | | | |
|---|---|---|---|
| 1,294,999 | 2/1919 | Brickman | 431/328 X |
| 2,594,914 | 4/1952 | Grosskloss | 126/92 R |
| 3,169,572 | 2/1965 | Constance et al. | 126/92 R X |
| 3,336,915 | 8/1967 | Fannon et al. | 126/92 B |
| 4,354,823 | 10/1982 | Buehl et al. | 126/92 AC X |

FOREIGN PATENT DOCUMENTS

| | | | |
|---|---|---|---|
| 763402 | 12/1956 | United Kingdom | 126/92 B |
| 1029774 | 5/1966 | United Kingdom | 126/92 B |

*Primary Examiner*—Randall L. Green

*Attorney, Agent, or Firm*—Flehr, Hohbach et al.

[57] ABSTRACT

A segmented radiant burner assembly for installation in the combustion chambers of firetube boilers and the like. The individual segments can be assembled together for on-site installation within the boiler. The segments include support structures comprising mounting flanges which are secured together in series to form the burner assembly. Gas and thermal sealing between the active material of the burner and the inactive support structure is provided by a sealing system which includes a dense fiber composition material and adhesive agent of ceramic composition. The mixture of unburned reactants is directed through a valving and manifold system into separate plena within the burner segments. The flow rates of reactants to the different burner segments is selectively controlled in a sequence which achieves a broad firing rate range.

15 Claims, 20 Drawing Figures

SEGMENTED RADIANT BURNER ASSEMBLY AND COMBUSTION PROCESS

This invention relates in general to combustion equipment and processes and in particular relates to fibrous radiant burners for installation and operation in the combustion chambers of firetube boilers and other similar combustion equipment.

Combustion equipment such as firetube boilers have previously been adapted to utilize radiant burners of a porous, ceramic fiber composition such as disclosed in U.S. Pat. No. 3,179,156. Combustion processes utilizing these radiant fiber burners are capable of achieving relatively high heat release rates and efficiencies with lower emissions in the products of combustion.

Radiant fiber burners of existing design have heretofore not been adaptable to scaling up for installation in large combustion equipment. For example, installation problems arise in attempting to retrofit large sized radiant fiber burners into the combustion chambers of large firetube boilers. The confined access space which typically exists around these boilers precludes retrofit of a single-piece large fiber burner into the combustion chamber.

Another requirement desirable in many combustion applications is the ability to operate on low firing loads for purposes of saving energy. For example, it is desirable to turn down the burners on combustion apparatus to achieve lower firing rates between periods of high energy demand. This requirement can arise in power stations where the boiler should be held at low loads during overnight periods and with steam readily available for daytime use periods. In conventional powered combustion burners the maximum turndown rate which is feasible is approximately 4:1, while with existing single piece fibrous radiant burners the maximum feasible turndown rate is no more than 2:1. A system which would achieve a greater range of firing rates would permit lower boiler turndown for energy savings between the periods of peak demand.

Existing radiant fiber burners are typically fabricated by processes which include vacuum forming a slurry of ceramic fiber-binder composition onto a mold to produce the desired shape, e.g. a cylindrical shell fiber layer having a rounded end. Fiber burners of flat plate configuration are also utilized for certain applications. During operation of these burners combustion is sustained uniformly along the outer surface of the fiber layer. In these conventional burner designs it has been difficult to attain suitable gas sealing at the junctures between the active burner surfaces and the inactive support surfaces. Optimum placement of the burner surfaces within the combustion chamber is thus difficult to achieve in many combustion applications.

It is therefore a general object of the present invention to provide a new and improved radiant burner assembly and combustion process for improved results in the construction and operation of combustion equipment.

Another object is to provide a radiant burner assembly in which separate burner segments are assembled together to form a complete burner for use in combustion equipment.

Another object is to provide a radiant burner for retrofit into combustion equipment and in which separate burner segments can be assembled and installed in the equipment within a confined space which would otherwise preclude installation of a one-piece burner of equivalent size and rating.

Another object is to provide a radiant burner assembly and combustion process having multiple burner segments to which the flow of unburned reactants is selectively controlled to achieve a wide firing rate range.

Another object is to provide a radiant burner assembly and method of fabrication in which segmented active burner surfaces and inactive support surfaces are connected together into a unitary burner configuration with optimum gas and thermal sealing at the interfaces between the surfaces.

Another object is to provide a segmented radiant burner assembly having improved sealing means between the active burner surfaces and the inactive surface of the support structure in the segments.

The invention in summary includes a radiant burner assembly having a plurality of segments which include active burner walls of porous fiber composition. A support structure extends along the periphery of the burner wall, and temperature-resistant sealing means is in adherence between the active burner wall and inactive support structure to provide a gas seal and thermal barrier. The segments are secured together by connection through the support structures to form a unitary burner configuration within the combustion chamber of the boiler or other combustion equipment. Unburned reactants are directed through a manifold system into plena of the segments under influence of a valve arrangement which is operated to selectively control the firing rate of each segment. Operation of the segments in a predetermined combination provides a wide range of overall firing rates for the burner assembly.

The foregoing and additional objects and features of the invention will appear from the following specification in which the several embodiments have been set forth in conjunction with the accompanying drawings.

Figure 1:
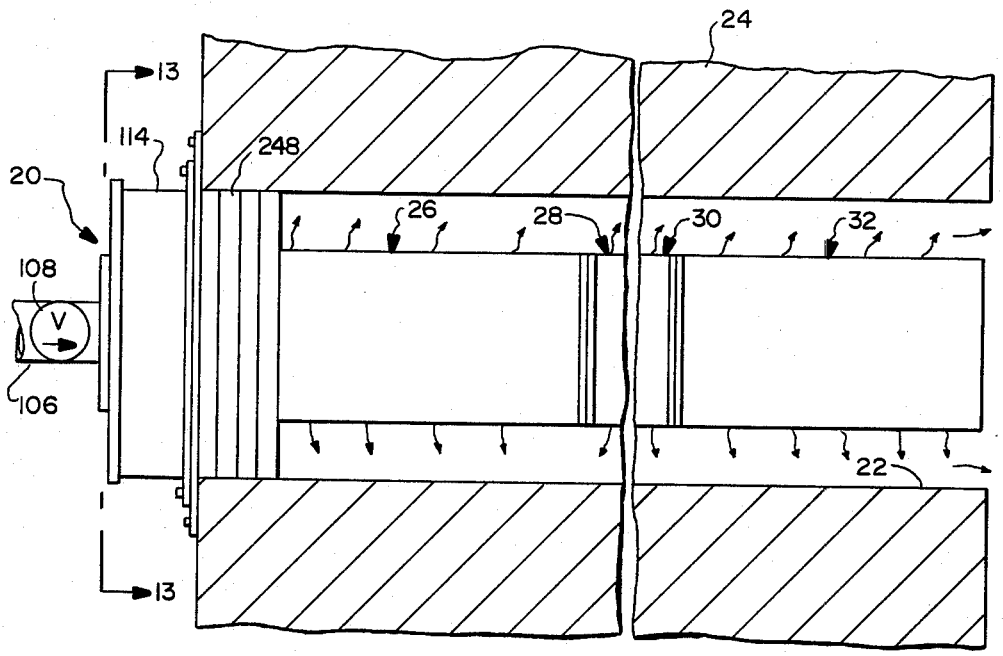
FIG. 1 is a side profile view of the radiant burner assembly shown installed in the combustion chamber of a typical firetube boiler.

In the drawings FIG. 1 illustrates generally at 20 a preferred embodiment of the segmented radiant burner assembly of the invention. The burner assembly 20 is illustrated as installed in the combustion chamber 22 of a typical firetube boiler 24. The invention contemplates that radiant burners embodying the concepts of the invention can be utilized in other combustion equipment, e.g. in process heaters employing burners of flat plate configuration.

As best illustrated in FIGS. 1–7 burner assembly 20 is comprised of a plurality of burner segments mounted in end-to-end relationship. In the illustrated embodiment four burner segments 26–32 are provided, and it is understood that the invention encompasses assemblies having any number of two or more segments as required by particular operating requirements and conditions. Each burner segment comprises an active burner wall 34 of porous fiber composition for supporting surface combustion of the gas reactants. Preferably the composition of the fiber burner wall is in accordance with U.S. Pat. No. 3,179,156 which is incorporated by reference into the present specification. Unburned gas reactants flow through interstitial spaces formed in the fiber composition wall and flamelessly combust in a zone along a shallow depth of the outer surface. Heat is transferred primarily by radiation and with some convection from the combustion zone outwardly to the heat exchange surfaces of the boiler firetube wall.

The fiber composition burner wall 34 is molded in the desired configuration commensurate with the shape of the combustion chamber, and in the illustrated embodiment this wall is in a cylindrical shell configuration to match the cylindrical combustion chamber 22 of the firetube boiler. A support structure for the wall 34 of each segment comprises a pair of axially spaced annular metal mounting flanges and a cylindrical perforated metal screen extending between the flanges. The fiber burner wall of the first segment 26 is supported by the pair of mounting flanges 36, 38 and metal screen 40, the burner wall of second segment 28 is supported by the pair of mounting flanges 42, 44 and screen 45, the burner wall of third segment 30 is supported by the pair of mounting flanges 46, 48 and screen 49, and the burner wall of the fourth and end segment 32 is supported by the pair of mounting flanges 50, 52 and screen 53. The mounting flanges of the segments in turn are attached to circular metal tubes 54, 56, 58, and 60. The annular spaces between the tubes and the inner surfaces of the burner walls define plena 62, 64, 66 and 68 through which the unburned reactants flow to the burner walls.

An important feature of the invention is the means for joining the active surfaces of the burner walls with the inactive surfaces of the support structures or mounting flanges to provide at the interfaces between the surfaces a gas-tight seal and thermal barrier. The gas-tight seal prevents leakage of reactants through the interface from the plena while the thermal barrier minimizes inward heat flow from the combustion zone and thereby prevents pre-ignition of the reactants within the plena. The method of sealing the interface further affords optimum positioning of both the active burner surfaces and the inactive surfaces within the combustion chambers. The sealing means of the invention permits the segments to be mechanically connected together without undue stress to the relatively fragile material of the porous burner wall, damage to which could cause cracks and therefore gas leakage.

Figure 8:
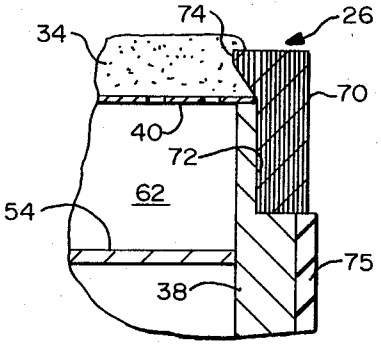
FIG. 8 is a fragmentary axial section view to an enlarged scale showing details of the means for sealing the interface between the active and inactive surfaces of the burner segments of FIG. 1.

FIG. 8 illustrates details of the sealing means at the downstream end of burner segment 26. The sealing means includes an annular layer 70 of a gas-impervious dense ceramic fiber composition seated in a circular recess 72 formed about the outer rim of mounting flange 38. Fiber layer 70 is comprised of bulk ceramic fibers and bonding agents. The ceramic fibers preferably are mixtures of alumina and silica and the preferred bonding agents comprise organic binders. The properties of the fiber layer include use limit temperatures of 2000° F. and nominal densities on the order of 15–18 lb./ft.$^3$ with minimal linear shrinkage at the use temperature limit. An example of a ceramic fiber composition suitable for use as the fiber layer in this invention is the material sold under the trademark Fiberfrax Duraboard LD by the Carborundum Company. The fiber composition material sold under the trademark M-Board by the Babcock & Wilcox Company is also suitable for use as the fiber layer in the invention.

As shown in FIG. 8 the fiber layer 70 is formed at its outer rim with a circular lip 74 which projects rearwardly into the body of the burner wall. An annular gasket 75 of a suitable compliant material such as silicone foam rubber is mounted between flange 38 and the flange 42 of the adjacent burner segment when the two are assembled together.

In the embodiment of FIG. 8 fiber layers 70 and 34 may be bonded to each other and to the inactive surfaces of the support structure 38, 40 by an adhesive agent. Preferably the adhesive agent is of ceramic composition having properties of high use temperature limits on the order of >2000° F. Adhesive agents of this class suitable for use in the invention include colloidal silicas such as sold by the Carborundum Company under the trademarks Rigidizer and Rigidizer W, and the colloidal silica sold by the Babcock & Wilcox Company under the trademark Kaowool Rigidizer. Other suitable adhesive agents for use in the invention include those sold by Alzeta Corporation under the trademark Astroceram, and an aqueous solution of Dispural, which is trademark for a product of Condea Chemie, Gmbh. The function of the adhesive agent is to improve bonding between the active and inactive surfaces, although under certain conditions suitable bonding between the surfaces can be achieved without the adhesive agent when the burner is molded and heat cured.

In the preferred embodiment for fabricating the first, second and third burner sections, sealing of the interfaces between the active and inactive surfaces is performed when the burner wall is molded onto its support structure using vacuum forming procedures. The mounting flanges 36, 38 are secured to opposite ends of cylindrical tube 54, and the perforate metal screen 40 is mounted at its opposite ends about the outer rim of the flanges. The fiber layers 70 are then fitted into the recesses of the flanges as shown in FIG. 8. An adhesive agent, as described above, in liquid solution form may then be coated on the upper and lower surfaces of lip 74 of each fiber layer as well as on the outer surface of sleeve 40. The assembly is then heated to a temperature in the range of 60°–90° C. for a period on the order of one-half hour or more to drive off the solvent and improve adherence to the surfaces. A slurry of the desired ceramic fiber and binder composition, e.g. as disclosed in U.S. Pat. No. 3,179,156, is then formed around the sleeve and in contact with the adhesive-coated surfaces. Preferably this step is performed by immersing the burner assembly into a bath of the slurry and then drawing a vacuum from within the structure. Following withdrawal of the assembly from the bath additional adhesive agent may be sprayed about the exposed interfaces between the burner wall and fiber layers, as required. The assembly is then baked at the required curing temperature, e.g. a temperature on the order of 600° F. for a period of two hours or more. This baking step cures the fiber and binder composition into the porous fiber ceramic burner wall and also cures the adhesive agent to form the seal between the active and inactive surfaces.

The fourth burner segment 32 is fabricated by mounting fiber layers 70 in the annular recesses provided in the end mounting flanges 50 and 52. An adhesive agent as specified above can be applied between the active and inactive surfaces and the burner wall is then molded onto the support structure using the vacuum forming procedures described above. A circular metal end plate 76 (FIG. 2) is then secured to the distal end of the segment closing off the void space within tube 60. A circular compliant silicone foam rubber gasket 78 preferably is mounted between the inner side of end plate 76 and the end mounting flange 52. One or more heat insulating cover plates 80 are secured as by bolting to the outer surface of end plate 76. Preferably the cover plates are comprised of the ceramic fiber composition described above for the fiber layers 70.

Figure 9:
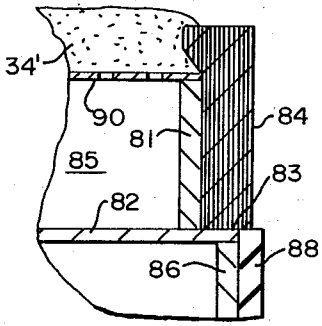
FIG. 9 is a fragmentary axial section view to an enlarged scale showing details of another embodiment for sealing the interface between the active and inactive surfaces of the burner segments of FIG. 1.

FIG. 9 illustrates another embodiment of the invention providing a modified version of the support structure and sealing means for the burner segments. In this embodiment the support structure at each end of the segment includes a metal ring 81 secured about the cylindrical tube 82 at a position spaced from the tube end to form an annular recess 83 for seating fiber layer 84. Ring 81 also encloses an end of the plenum 85 for the segment. A second metal ring 86 is mounted at each end about the inner diameter of tube 82 and abuts the tube end. An annular gasket 88 of a suitable compliant material such as silicone foam rubber is mounted on the end surface of ring 86 to abut the corresponding ring of the adjacent burner segment when assembled together. A perforate metal cylindrical sleeve 90 is mounted about the structure between the rings. The fabricating method described above for the embodiment of FIG. 8 is carried out to mold ceramic fiber burner wall 34 and the preferred adhesive agent to sleeve 90 and to the inactive surfaces of fiber layer 84 to form the gas-tight seal and thermal barrier.

Figure 10:
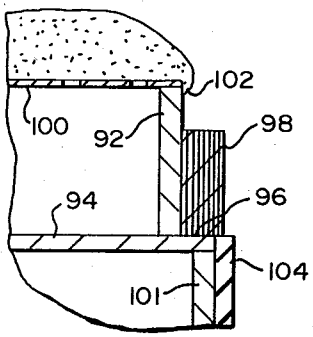
FIG. 10 is a fragmentary axial section view to an enlarged scale showing another embodiment of the means for sealing the interface between the active and inactive surfaces of the burner segments of FIG. 1.

FIG. 10 illustrates another embodiment of the invention providing a modified version of the support structure and sealing means for the interface between the active and inactive surfaces. In this embodiment a pair of metal rings 92 are secured about opposite ends of cylindrical tube 94 at positions spaced from the tube ends to provide recesses 96 for seating fiber layer 98. The fiber layer is annular with a radial width less than the depth of recess 96, and without an inwardly projecting lip, so that the outer rim of layer 98 is spaced inwardly from the outer edge of ring 92. The outer surface portion of ring 92 which is exposed above the rim of fiber layer 98 is the inactive surface along which the gas-tight seal is to be effected with the resulting burner wall 34. A perforate metal cylindrical screen 100 is mounted about the structure between the opposite rings, and a pair of metal rings 101 are mounted within the opposite ends of tube 94. The porous fiber composition burner wall is molded about the screen with a circular lip portion 102 of the fiber wall projecting inwardly and lapping over the circular juncture between screen 100 and ring 92, and with the preferred adhesive agent as described above bonding the fiber layer to the surfaces of the screen and ring. The method of fabricating the burner segment of FIG. 10 is similar to that described for the embodiment of FIG. 8 with the modification that, prior to immersion in the bath for vacuum forming, the adhesive agent may be coated along the exposed outer surface of ring 92 as well as on the screen surface. In this embodiment an annular gasket 104 of suitable compliant material such as silicone foam rubber is mounted on the outer face of ring 101 for contact with the outer face of the corresponding ring of the adjacent burner segment when assembled together.

Figure 12:
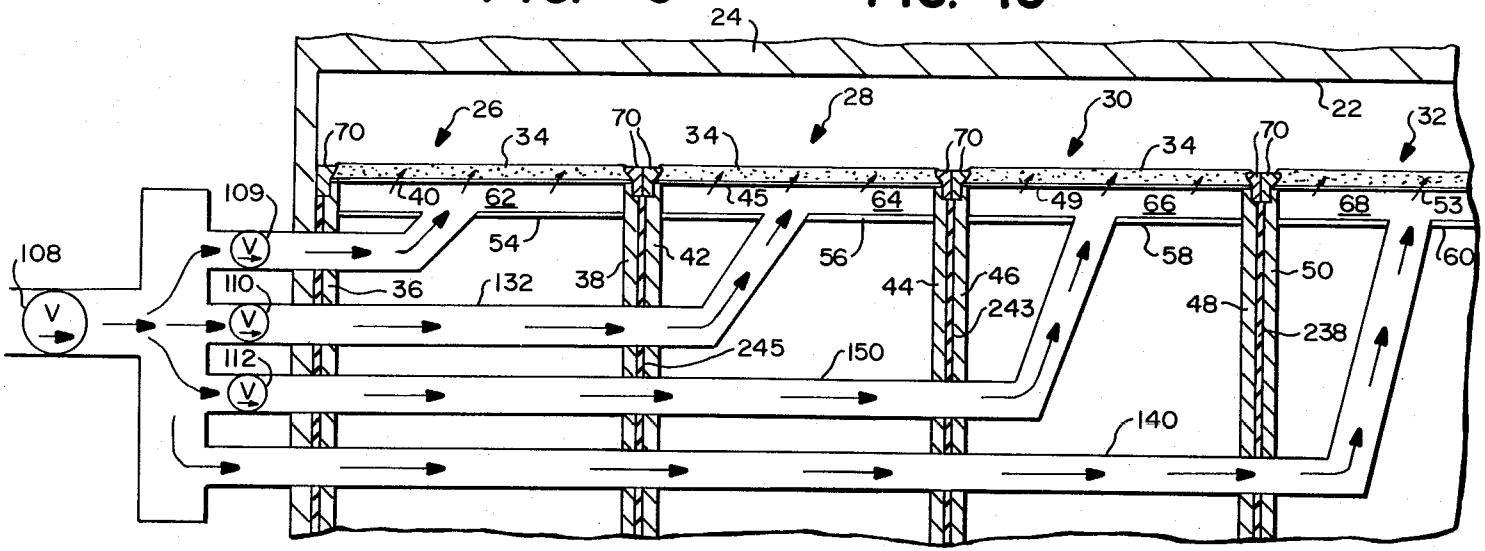
FIG. 12 is a schematic drawing of the manifold conduit system and valving arrangement for controlling the flow of unburned reactants to the segments of the burner assembly of FIG. 1.

The inlet stream of unburned reactants is directed into burner assembly 20 through a main conduit 106 connected with a primary control valve 108. The primary valve in turn is connected with secondary control valves 109, 110 and 112 which are mounted within valve housing 114 as shown in the schematic of FIG. 12 and the assembly drawing of FIG. 14. The mainstream flow is subdivided within valve housing 114 into secondary streams through which the flow rates are controlled by the secondary valves.

Figure 7:
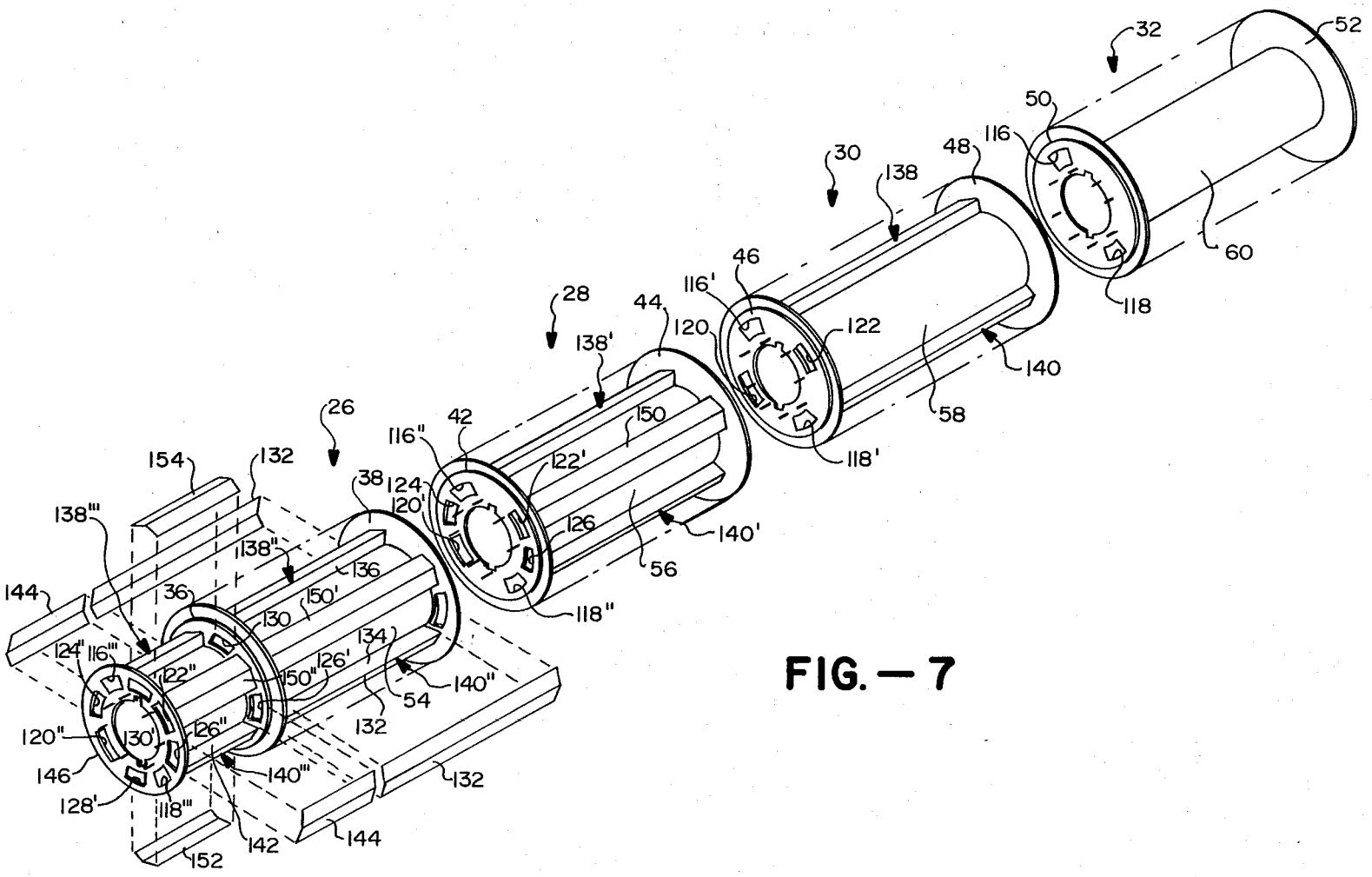
FIG. 7 is an exploded perspective view of the burner segments for the assembly of FIG. 1.

A system of conduits or flow channels is provided for directing the secondary streams from the valves to the different burner segments. This systems includes a series of inlet ports 116–130 (FIGS. 3–6) which are formed in the mounting flanges of the segments and oriented so that the ports of opposing flanges are in register. The ports are arrayed about the mounting flanges for communicating with the annular spaces 62–68 between the support tubes and burner walls. As shown in FIG. 7 for the exploded view of the first burner segment 26, a series of top plates 132, and side plates 134, 136 are secured together as by welding on top of the tubes 54–60 to form channels or conduits 138, 140 which extend between the end flanges of each segment and are aligned with the ports for channeling the flow completely through that segment and on into the downstream segment. Radial clearance is provided between the top plates and inner surfaces of the burner walls to permit reactants to circulate within the plenum.

Inlet ports which feed reactants into the plenum of a segment are open into the annular space, and there are two such open inlet ports formed through the upstream mounting flange of each segment. For example, the pair of diametrically opposed inlet ports 116, 118 formed in flange 50 of the fourth or end segment 32 open directly into the plenum of annular space 68 to feed reactants to the burner wall of that segment. The conduits 138, 140 which direct flow to the ports 116, 118 are formed by a series of plates extending between the pairs of ports 116', 118' formed in the flanges of third burner segment 30, through a series of plates extending between the pairs of ports 116", 118" formed in the flanges of second burner segment 28, and through a series of plates extending between the pairs of ports (not shown) formed in the flanges of first burner segment 26. The flow is directed to the first burner segment by conduits 138''' and 140''' defined by a series of shorter plates 142, 144 which extend across tube extension 145 (FIG. 14) from the inlet ports 116''', 118''' formed in burner front plate 146.

Similarly, the flow of reactants to third burner segment 30 is fed through the pair of diametrically opposed ports 120, 122 which open through the upstream flange 46 into the plenum of annular space 66. The conduits 150 directing flow to these ports are formed by series of plates mounted between the opposite ends of flanges 42, 44 of the second burner segment, by the conduits 150' formed by the series of plates mounted between the pairs of ports in the opposite end flanges 36, 38 of first burner segment 26, and by the conduits 150" which extend to the inlet ports 120", 122" in the front plate 146.

The flow of reactants is fed into second burner segment 28 through the diametrically opposed pair of ports 124, 126 formed in upstream flange 42 and which open into the plenum of annular space 64. The conduits for directing flow into these ports is provided by the series of plates 132 mounted between the pairs of ports formed in opposite flanges 36, 38 of first segment 26, and by the series of plates 144 which extend to the inlet ports 124", 126" in the front plate.

The flow of reactants into first segment 26 is directed through a pair of diametrically opposed ports 128, 130 formed through the upstream flange 36 and which open into the plenum of annular space 62, and by conduits formed by the series of plates 152, 154 which project over the tube extension 145 to inlet ports 128', 130' in the front plate.

Figure 14:
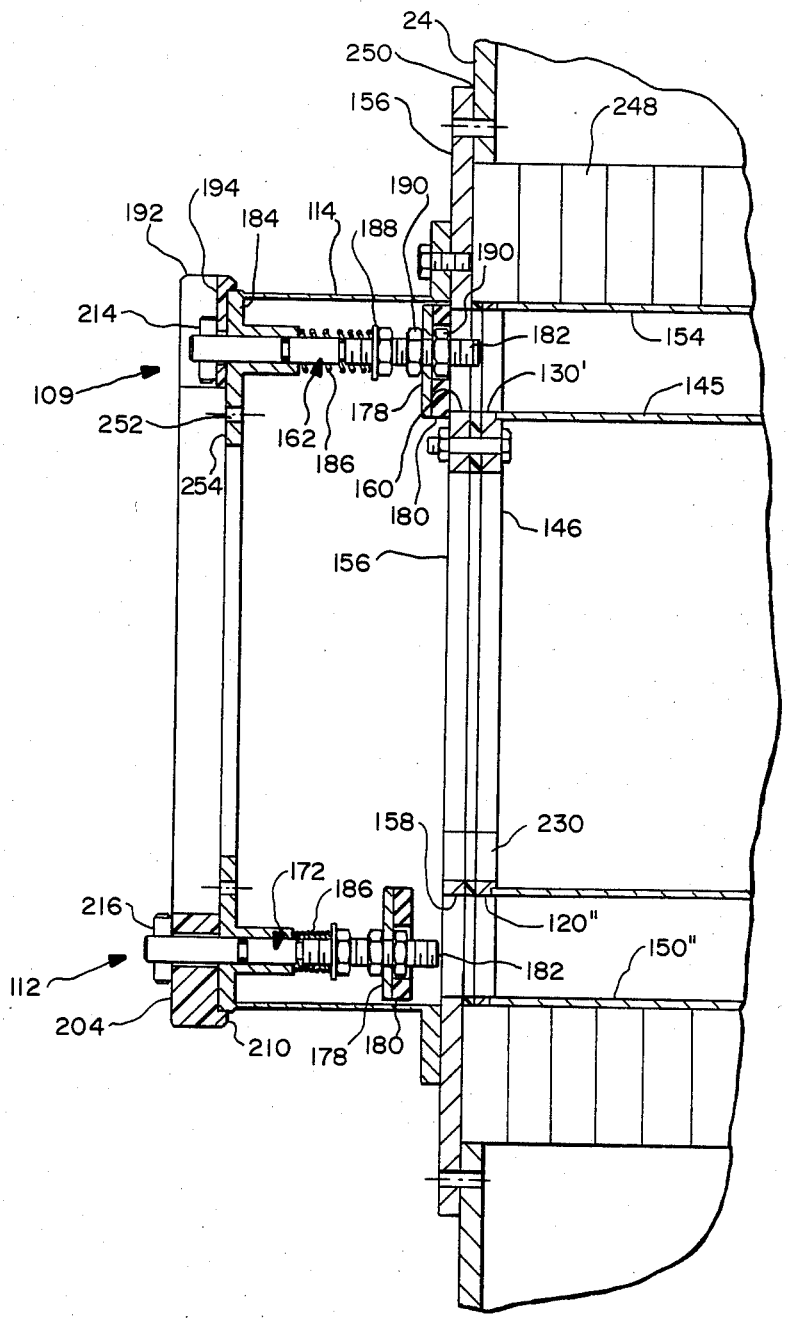
FIG. 14 is a fragmentary axial section view taken along the line 14—14 of FIG. 13 showing details of the secondary valves and cam mechanism of FIG. 13.

A valve plate 156 is mounted on the end of burner front plate 146. The valve plate is formed with diametrically opposed pairs of valve ports which are in register with the corresponding ports in front plate 146 leading to the different burner segments. FIG. 14 shows one of these valve ports 158 in register with inlet port 120" and conduits 150" with direct reactant flow along the path to the third burner segment 30. The FIG. 14 also shows another of the valve ports 160 in register with the inlet port 130' and conduits formed by plates 154 which direct reactant flow to first segment 26.

Figure 13:
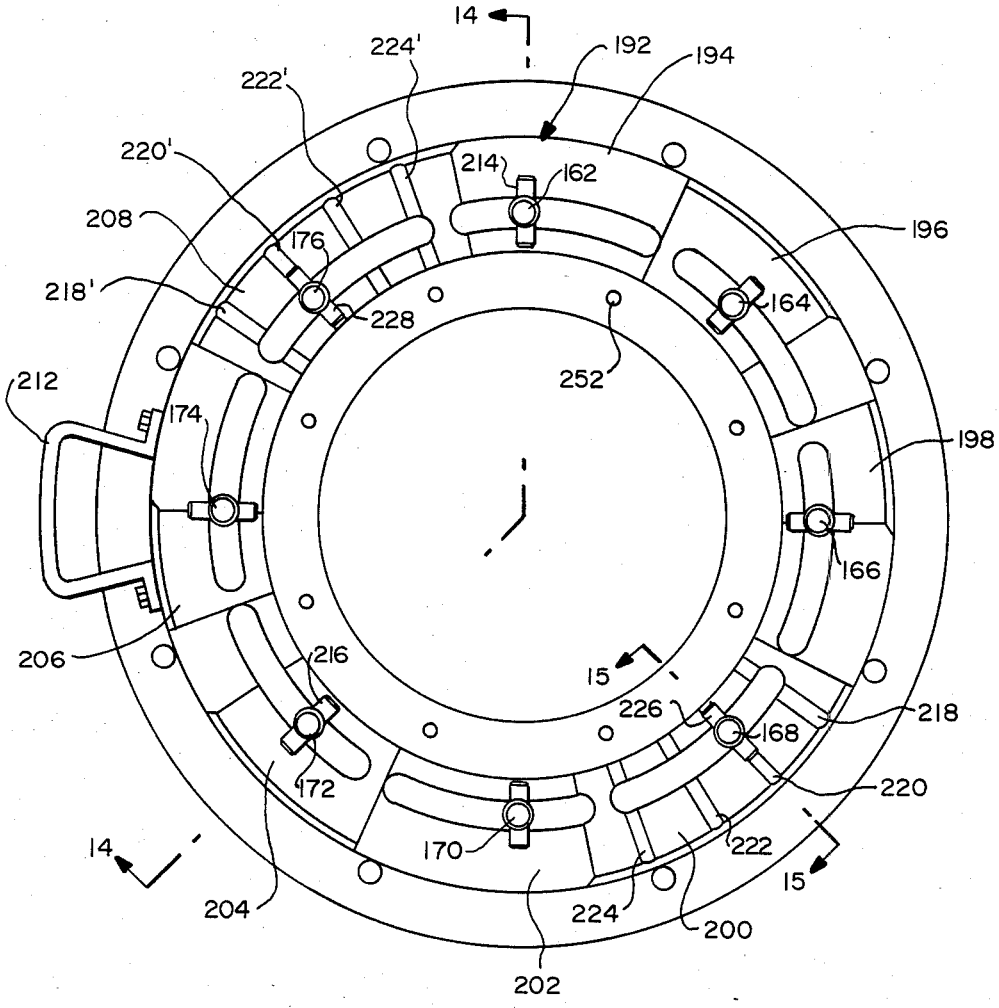
FIG. 13 is an end view taken along the line 13—13 of FIG. 1 showing details of the valve operating mechanism for the burner assembly of FIG. 1.
Figure 15:
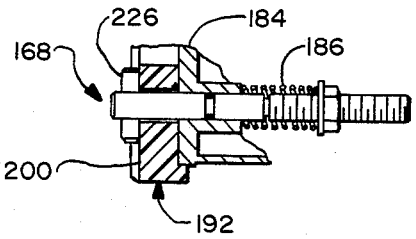
FIG. 15 is a fragmentary axial section view taken along the line 15—15 of FIG. 13 showing details of the cam track and cam follower of the valve operating mechanism for the burner assembly.

The secondary valve mechanism is illustrated in greater detail in FIGS. 13–15. Valve housing 114 carries a plurality of circumferentially spaced cam-operated poppet valves 162–176 each of which registers with a respective valve port. Each poppet valve includes a valve plate 178 which carries an elastomeric face 180 shaped to conform with the cross-sectional shape of the valve port. In the preferred embodiment the shape of the valve ports as well as the flow channels are generally crescent-shaped segments with large cross sections to minimize flow resistance and thereby reduce pumping requirements. Other cross-sectional shapes, e.g. circular, could be provided for the channels and ports.

Each of the valve plates is carried on the threaded end of a valve stem 182 which in turn is slidably mounted in a bore formed through the headplate 184 of housing 114. A compression spring 186 is mounted about each valve stem and seats against a washer 188 and nut for normally urging the valve plate and face into closed position against the valve port. A pair of adjusting nuts 190 capture opposite sides of the valve plate for purposes of adjusting valve clearance.

A camming mechanism is provided for operating the secondary valves in a pre-determined sequence for purposes of staged turndown of the burner segments. The camming mechanism includes a cam plate 192 mounted on the outer end of housing 184 with diametrically opposed pairs of circular segment cam tracks 194–208 formed about the outer face of the cam plate. Cam plate 192 is provided with an inwardly projecting rim 210 adapted to slidably rotate on the housing about the central axis of the burner. The cam plate is manually rotated by means of one or more handles 212. As required, a suitable motor and drive train arrangement, not shown, could be provided to rotate the cam plate to the required valve-operating positions. Preferably the cam surfaces, or the entire cam plate, is made of a suitable low-friction material such as the synthetic polymer sold under the trademark Delrin by the DuPont Company.

Each opposed pair of cam tracks is adapted to simultaneously operate one of the pairs of opposed secondary valves. Cam followers comprising cylindrical pins 214, 216 are transversely mounted through openings formed in the ends of the valve stems which project outwardly from the cam plate. Each of the secondary valves is moved to its open position, as illustrated for the valve 112 of FIG. 14, when the cam plate is turned to a position where the cam rise 204 engages and moves cam follower pin 216 outwardly. When the cam plate is moved to a position where there is a low cam profile in register with the cam follower pin then spring 186 is enabled to urge the valve to its closed position, as shown for the valve 109 of FIG. 14.

In the illustrated embodiment there are three pairs of valve plates provided on the valve stems for opening and closing flow to the first to third burner segments 26, 28 and 30. The remaining pair of valve stems 168, 176 are assembled as shown in FIG. 15 without valve plates and are mounted on the housing in register with the valve ports 116, 118 opening into the conduits 138, 140 which feed reactants to the fourth or end burner segment 32. Through this arrangement the flow of reactants downstream of primary valve 108 is always in communication with the fourth segment, as shown in the schematic diagram of FIG. 12. The secondary valve 112 comprising the pair of valve stems 164, 172 open and close flow to the conduits leading to third segment 30, the secondary valve 110 comprising the pair of valve stems 166, 174 open and close flow to the conduits leading to second segment 28, and the secondary valve 109 comprising the pair of valve stems 162, 170 open and close flow leading to first segment 26.

The valve stems 168, 176 provide the function of releasably locking cam plate 192 about the axis of rotation at four positions in which the secondary valves are in series fully opened or closed, as the case may be. As shown in FIG. 13 on diametrically opposed segments of the cam plate pairs of radial grooves 218–224 are formed, each pair of which corresponds to one of the cam plate positions. Cam follower pins 226, 228 are mounted transversely through openings formed in the heads of the valve stems and the pins are adapted to roll in and out of the grooves as the cam plate is turned.

For operating the burner under full load with the primary and secondary valves fully opened, cam plate 192 is turned to the position at which the pair of grooves 218, 218' register and releasably lock with the follower pins of valve stems 168, 176. In this position the high profiles of the six remaining cam surfaces are in position under the respective valve pins so that the valves which they are associated with are moved to the fully opened positions.

For the next stage of burner turndown first burner segment 26 is shut down by turning the cam plate counter clockwise as viewing in FIG. 13 through an arc which carries the second pair of grooves 220, 220' in register and releasably locking with the follower pins of valve stems 168, 176. In this position the low profiles of the cam surfaces 194, 202 are moved into register with valves pins 214 so that the associated valves 162, 170 are moved by spring action to the right as viewed in FIG. 14 for seating against the valve ports and closing off flow into the first segment.

For the next stage of burner turndown second burner segment 28 is turned off by moving cam plate 192 further counter clockwise to the position at which the pair of grooves 222, 222' releasably lock with the pins of valve stems 168, 176. In this position the low profile of cam surfaces 198, 206 are moved into register with cam follower pins of valves 166, 174 which are moved by spring action to seat against and close the associated valve ports and shut off flow to the second segment. In this position the profiles of the other cam surfaces permit the valves controlling the flow to the first segment to remain closed, while the profiles for the cam surfaces continue to hold open the valves which control flow to the third segment.

In the next stage of burner turndown the third burner segment 30 is shut off by turning cam plate counter clockwise through a further are until the pair of grooves 224, 224' register and releasably lock with the pins of valve stems 168, 176. In this position the low profiles of cam surfaces 196, 204 are in register with the cam follower pins of valves 164, 172 which are urged by spring action to seat against and close the valve ports leading to the third segment. In this position the profiles of the remaining cam surfaces permit the other valves to remain closed so that only the fourth burner segment is in operation.

A further stage of burner turndown is achieved by controlling primary valve 108 to throttle the mainstream flow rate. A maximum turndown rate can be achieved with the cam plate turned to the position in which all of the secondary valves are closed and by controlling the primary valve to throttle the mainstream flow rate. With the maximum practical throttling of the flow rate to each burner being 50%, the maximum turndown rate would be 8:1 where all of the secondary valves are closed and the primary valve is set to throttle the flow to the end segment at 50%. Intermediate turndown rates can be achieved by a selected combination of control of the primary and secondary valves. Thus, with the primary valve fully open the firing rate is 75% with the first segment off, 50% with the first and second segments off and 25% with the first through third segments off. Another example of an intermediate firing rate is where the primary valve is throttled to 70% with the first and second segments shut off giving a combined firing load of 35%.

Figure 11:
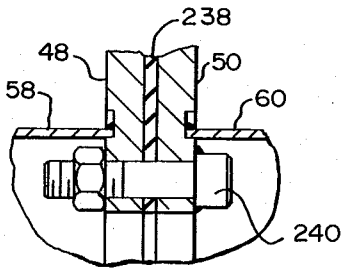
FIG. 11 is a fragmentary axial section view to an enlarged scale showing details of the means for connecting together the segments of the burner illustrated in FIG. 2.

The installation and operation of burner assembly 20 into the combustion apparatus 24 is as follows. At the installation site the individual segments are assembled by means of an elongate mandrel or other end support, port, not shown, adapted to be mounted within the opening of combustion chamber 22. Opposed pairs of alignment nothes 230–236 are formed on the inner rims of the mounting flanges and front plate 146, as shown in FIGS. 3–6. The alignment notches are adapted to slidably engage elongate ribs formed on opposite sides of the mandrel. The end burner segment 32 is first mounted on the mandrel in front of the chamber opening. The third burner segment 30 together with a complaint gasket 238 are then mounted on the mandrel and joined with the upstream flange 50 of the fourth segment. Means for securing the two segments together is shown in FIG. 11 and comprises a plurality of the bolts 240 which are secured through openings in the abutting flanges 48, 50 within the void space 242 of tubes 58 and 60. Tightening of the bolts compresses the gasket 238 between the flanges to form gas-tight seals about the inlet ports which feed the fourth segment plenum. The opposed pair of fiber layers 70 carried by the two segments abut to provide a thermal barrier.

The assembled third and fourth segments are then advanced on the mandrel further into the chamber. The second segment 28 together with a compliant gasket 243 are then mounted on the mandrel and connected with the upstream flange of the third segment in a similar manner. The three assembled segments are then advanced into the chamber. The first segment 26 together with another compliant gasket 245 are then mounted on the mandrel and fastened to the upstream flange of the second segment in a similar manner. The four assembled segments are then advanced into the chamber. A plurality of annular heat insulating fiberboard spacers 248 are mounted about the tube extension 145. Valve plate 156 is then bolted to the front plate of the burner 146 and to the broiler 24 as shown in FIG. 14. A gasket seal is provided at the interface 250 between the boiler front and the valve plate. Valve housing 114 together with its associated secondary valves and cam mechanism is then bolted to plate 156. Main conduit 106 together with the primary control valve 108 are then connected by bolts through the openings 252 in the intrusion flange 254 of the valve housing.

With burner assembly 20 installed in the combustion chamber in the manner described the flow of reactants, e.g. pre-mixed fuel and air, is directed to the burner segments by operating the primary and secondary control valves in the selected sequence for either full load operation or the desired turndown rate. For example, an 8:1 turndown rate can be selected for stand-by operation of the burner to save energy during periods of low power demand.

During operation of the burners the sealing means prevents leakage of reactants at the junctures between the segments and additionally minimizes inward heat flow to prevent flashback. The resulting seal is durable and capable of withstanding sustained high temperature combustion conditions. The ability to provide a sealed interconnection between the relatively fragile structure of the burner wall and the inative metal support permits optimum location of the surfaces within the combustion chamber. Thus, the mounting of the inactive surfaces on the distal end of the fourth segment, including the metal end plate 78 and fiberboard cover plate 80 which it carries, lowers the temperature of the flue gas discharging from the combustion chamber and entering the second pass of the boiler. This lower flue gas temperature results in lower metal temperatures and increased boiler life.

Figure 16:
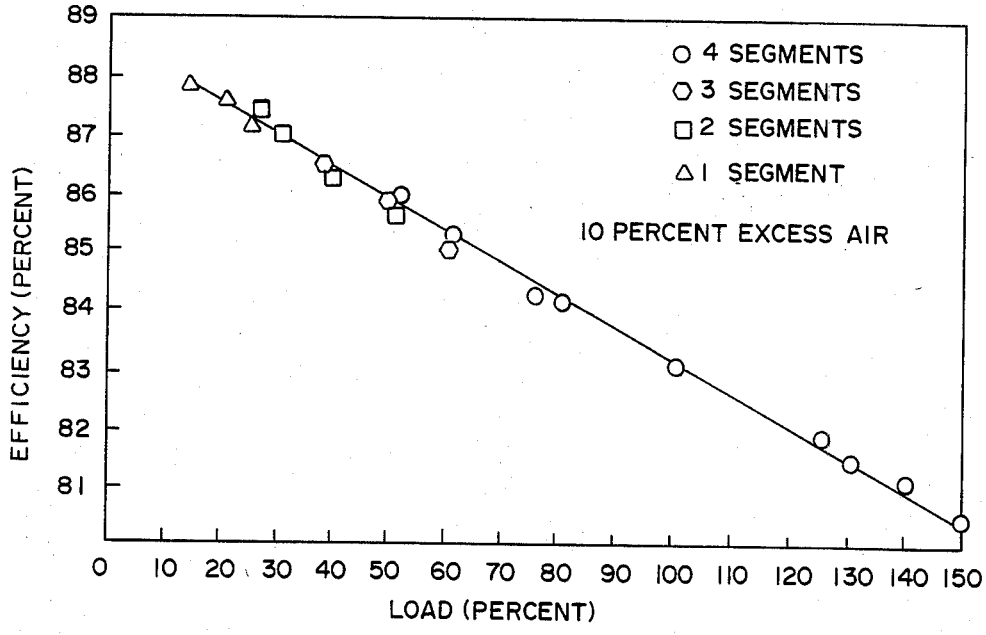
FIG. 16 is a graph plotting efficiency as a function of boiler load during operation of a burner assembly constructed in accordance with the embodiment of FIG. 1 and mounted in a boiler.
Figure 2:
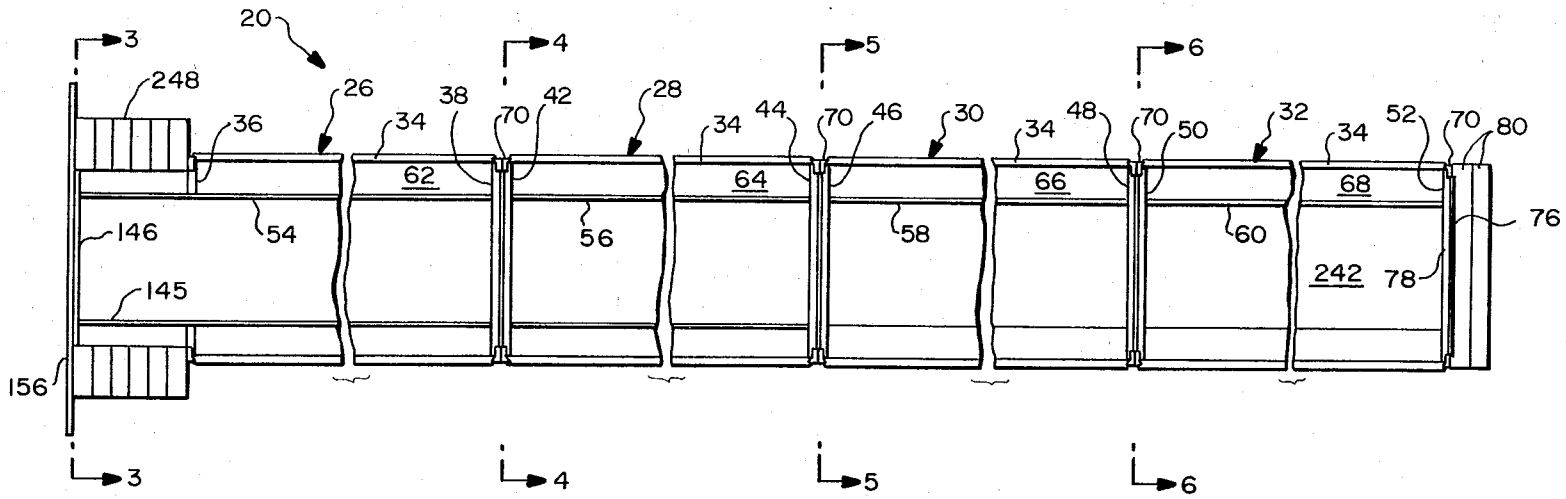
FIG. 2 is an axial section view, partially broken away, of the burner segments for the assembly of FIG. 1.
Figure 6:
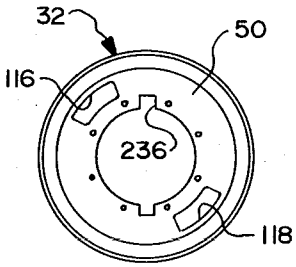
FIG. 6 is a cross-sectional view of the burner taken along the line 6—6 of FIG. 2.
Figure 5:
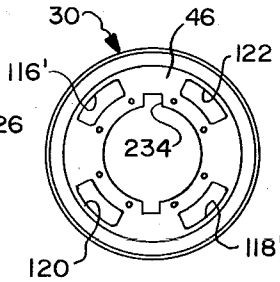
FIG. 5 is a cross-sectional view of the burner taken along the line 5—5 of FIG. 2.
Figure 4:
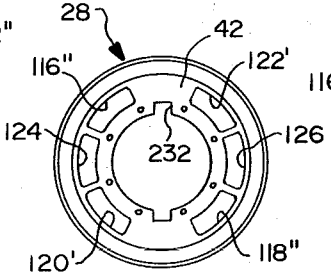
FIG. 4 is a cross-sectional view of the burner taken along the line 4—4 of FIG. 2.
Figure 3:
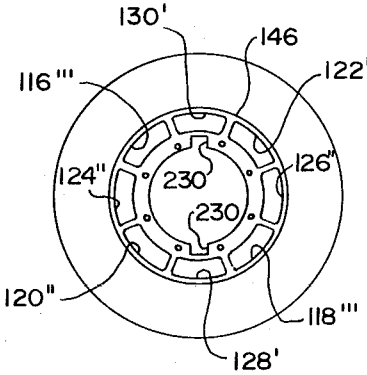
FIG. 3 is a cross-sectional view of the burner taken along the line 3—3 of FIG. 2.

Operation of the segmented burner assemblies of the invention achieves outstanding efficiency and emission performance. For example, a four burner segment as shown in FIG. 1 was installed in a 25-hp boiler. Performance data was obtained in stages of operation of from one to four segments fired, and the operating results ae depicted in the graphs of FIGS. 16–20. The graph of FIG. 16 plots efficiency as a function of boiler load with the indicated symbols depicting the data parts with various combinations of the segments in operation, all at 10% excess air. The graph shows that a firing load range of 13% to 150% was achieved for the burner assembly.

Figure 17:
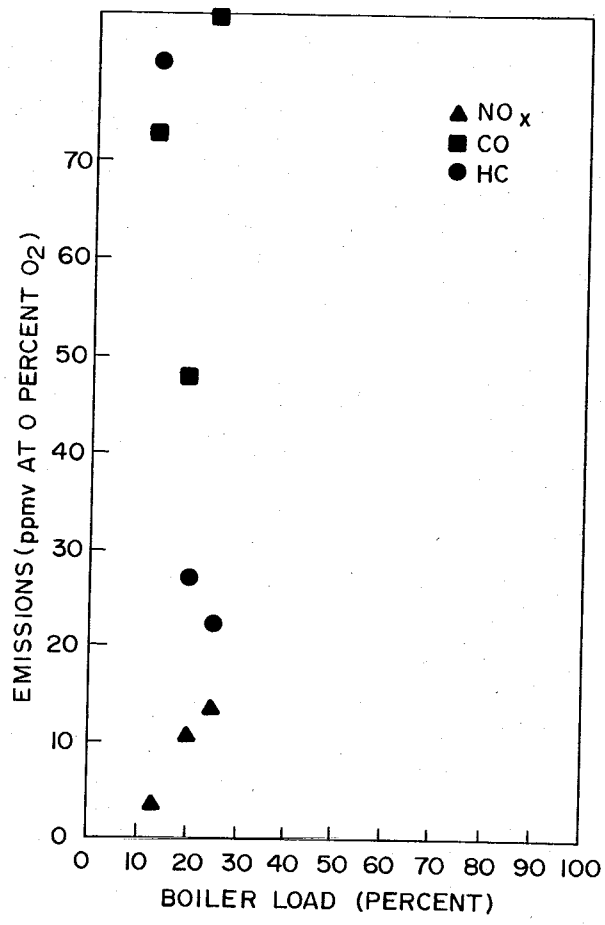
FIG. 17 is a graph plotting emissions as a function of boiler load for the burner assembly as described for FIG. 14 with one of the segments operating.
Figure 18:
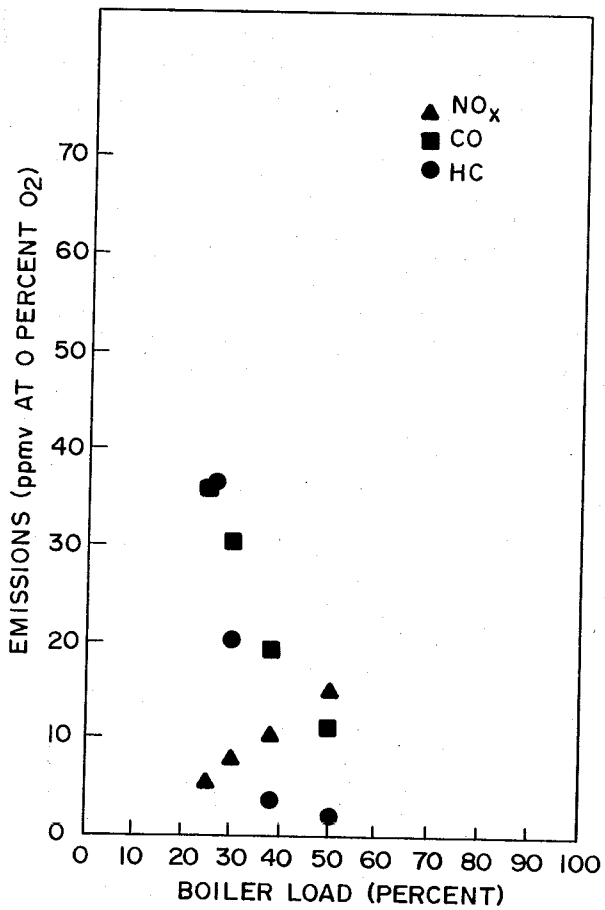
FIG. 18 is a graph plotting emissions as a function of boiler load for the burner assembly as described for FIG. 14 with two of the segments operating.
Figure 20:
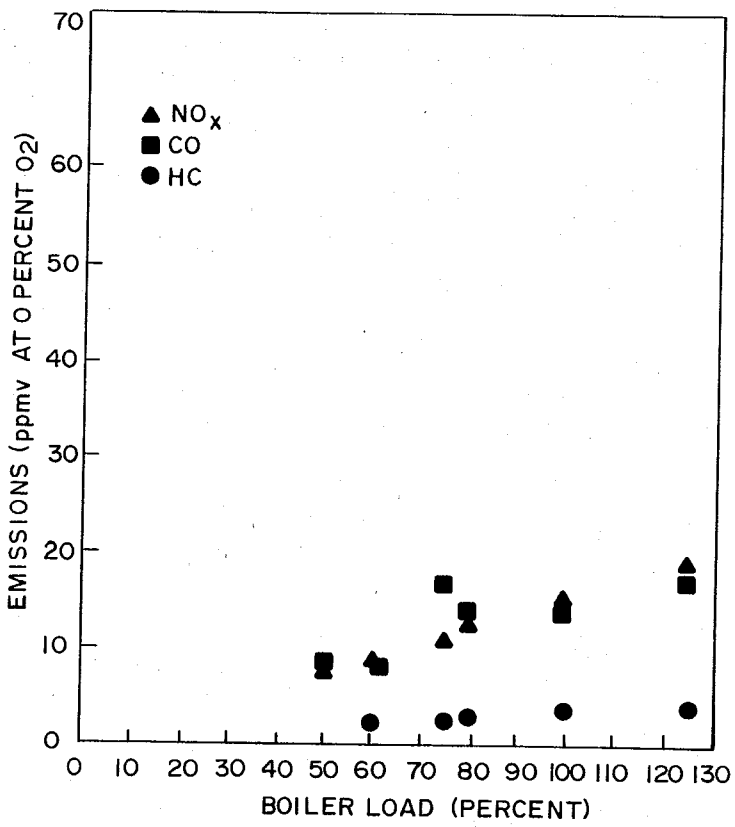
FIG. 20 is a graph plotting emissions as a function of boiler load for the burner assembly as described for FIG. 14 with all four segments operating.
Figure 19:
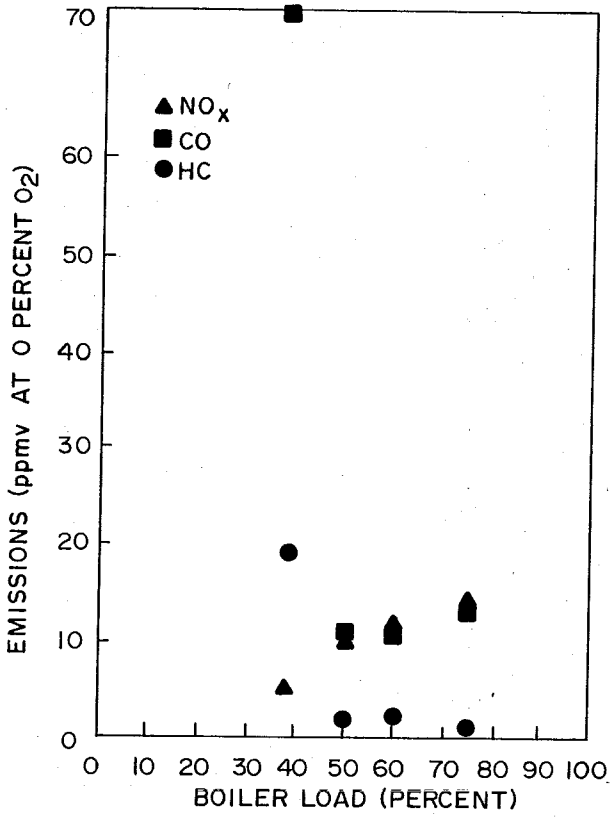
FIG. 19 is a graph plotting emissions as a function of boiler load for the burner assembly as described for FIG. 14 with three of the segments operating.

The graph of FIG. 17 plots emissions of $NO_x$, CO and hydrocarbons as a function of boiler load with only one segment in operation. FIG. 18 is a graph plotting emissions of $NO_x$, CO and hydrocarbons as a function of boiler load with two of the segments operating. FIG. 19 is a graph plotting emissions of $NO_x$, CO and hydrocarbons as a function of boiler load with three of the segments operating. FIG. 20 is a graph plotting emissions of $NO_x$, CO and hydrocarbons as a function of boiler load with all four segments operating. These graphs demonstrate that performance increases as more segments are fired, but even in the case of single segment operation the emission levels are quite acceptable.

The operating result from the four segment burner in the 25-hp firetube boiler at 100% load also demonstrates significant temperature reduction in the flue gases. These results are compared with operation of a single piece fiber burner of equivalent size inthe firetube boiler as follows: the gas temperature at the end of the first pass for the segmented fiber burner of the invention was 1625° F. as compared to 1925° F. for the single piece burner; the gas temperature at the entrance to the second pass of the boiler was 1250° F. for the segmented fiber burner while the comparable temperatures for the single piece fiber burner was 1390° F.; and the temperature of the rear boiler surface from operation of the segmented fiber burner was 520° F. while the comparable rear boiler surface temperature during operation of the single piece fiber burner was 700° F. These reduced temperatures provide longer boiler life with resulting reduced costs for maintenance, replacement and boiler down time.

While the foregoing embodiments are at present considered to be preferred it is understood that numerous variations and modifications may be made therein by those skilled in the art and that all such variations and modifications fall within the true spirit and scope of the invention.

What is claimed is:

1. A radiant burner assembly for installation in a combustion chamber comprising the combination of a plurality of burner segments, each segment including an active burner wall of porous fiber composition for supporting surface combustion of reactants and a support structure comprised of a material which is inactive for combustion, said wall joined with said support structure along an interface to at least partially enclose a plenum for the unburned reactants, sealing means extending along the interface and adhering therealong to the surfaces of the wall and support structure to seal the interface, securing means for joining together in abutting relationship the facing portions of the support structures of adjacent segments to form a unitary burner assembly, and means forming flow channels for serially directing an inlet stream of unburned reatants from one end of the assembly into the plena of the segments, said flow channels being openings formed in the facing portions of the support structures for communicating respective plena of adjacent segments.

2. A radiant burner assembly as in claim 1 in which each burner wall is in the shape of a cylindrical shell and a cylindrical tube is concentrically mounted within and radially spaced from the shell of each segment to form an annular space which defines the plenum of such segment.

3. A radiant burner assembly as in claim 2 in which the burner segments are joined in end-to-end relationship along a common axis to form an elongate burner assembly for mounting in the combustion chamber.

4. A radiant burner assembly as in claim 3 which includes annular mounting flanges forming said facing portions of the support structure, said flanges being mounted at opposite ends of the cylindrical shell, and the securing means joins together the opposing flanges of adjacent burner segments.

5. A radiant burner assembly as in claim 4 which includes compliant gasket means mounted between the opposing flanges of adjacent burner segments to form a seal to inhibit gas leakage from the plena.

6. A radiant burner assembly as in claim 1 in which the sealing means comprises an adhesive agent of ceramic composition bonded between the active and inactive surfaces along the interface.

7. A radiant burner assembly as in claim 1 in which the sealing means comprises a layer of gas-impervious ceramic fibers bonded between the active and inactive surfaces along the interface to provide a seal against gas leakage from the plena and to further provide a thermal barrier between the combustion zone and the interior of the burner.

8. A radiant burner assembly as in claim 7 in which a temperature-resistant adhesive agent is bonded between the gas-impervious layer and the active surface of the burner wall and also between the gas-impervious and active fiber layers and the inactive surface of the support structure.

9. A radiant burner as in claim 1 for installation in a firetube boiler which includes a combustion chamber having a discharge end, the invention further characterized in that one of said segments of the burner assembly is installed at a position adjacent the discharge end of the combustion chamber, and an inactive cover plate is mounted on the support structure of said one segment for limiting temperatures of exhaust gases from the chamber.

10. A radiant burner assembly as in claim 1 in which the means for directing the reactants into the plena includes means forming ports in the support structures of each segment, and the adjacent segments are mounted together with opposing ports in register to form flow passage means for channeling reactants into the plena of segments downstream in the flow.

11. A radiant burner assembly as in claim 10 which includes means forming conduits along the segments for directing the inlet stream of reactants into separate secondary streams each of which leads to the plena of one segment which is independent of the other segments, and secondary control means for controlling the reactant flow rate in at least one of the secondary streams to thereby control the burner firing rate of the respective segment.

12. A radiant burner assembly as in claim 11 which includes primary control means for controlling the reactant flow rate in the inlet stream which divides into the secondary streams whereby the firing rates of the burner segments are selectively controlled by a selected combination of the primary control means and the secondary control means.

13. A radiant burner assembly as in claim 11 which includes a main conduit for directing the inlet stream of reactants into the burner assembly, a manifold for dividing the inlet flow from the main conduit into the secondary streams, and the secondary control means comprises valve means in at least one of the secondary streams for controlling the flow rate of reactants to the respective segment separately from control of the reactant flow rate of the other segments.

14. A radiant burner assembly as in claim 13 in which the valve means includes means forming valve ports in the conduit means, valves mounted for movement to open and close the valve ports, and valve operating means for controlling movement of the valves to selectively open and close ports leading to thhe different burner segments whereby the segments can be operated in a selected combination to provide a range of overall firing rate of the burner assembly.

15. A radiant burner assembly as in claim 14 which includes primary control means for controlling the flow of reactants in the main conduit with the stream of reactants leading to the last segment remote from the manifold being controlled by the primary control means, and the stream of reactants leading to the segments located upstream of the last segment being controlled by the secondary valve means.

* * * * *